US006729151B1

(12) United States Patent
Thompson

(10) Patent No.: US 6,729,151 B1
(45) Date of Patent: May 4, 2004

(54) HEAT PUMP FLUID HEATING SYSTEM

(76) Inventor: Peter Forrest Thompson, 19 Bradbury Road, Howick, Auckland (NZ), 1705

( * ) Notice: Subject to any disclaimer, the term of this patent is extended or adjusted under 35 U.S.C. 154(b) by 0 days.

(21) Appl. No.: 10/089,045

(22) PCT Filed: Sep. 25, 2000

(86) PCT No.: PCT/NZ00/00186

§ 371 (c)(1),
(2), (4) Date: Aug. 2, 2002

(87) PCT Pub. No.: WO01/22011

PCT Pub. Date: Mar. 29, 2001

(30) Foreign Application Priority Data

Sep. 24, 1999 (NZ) ..... 337983

(51) Int. Cl.[7] ..... F25B 27/00; G05D 23/00
(52) U.S. Cl. ..... 62/238.6; 237/28
(58) Field of Search ..... 62/238.6, 238.7

(56) References Cited

U.S. PATENT DOCUMENTS 4,089,667 A * 5/1978 Jonsson ..... 62/238.6
4,199,955 A * 4/1980 Jonsson ..... 62/79
4,311,498 A * 1/1982 Miller ..... 62/181
4,373,346 A * 2/1983 Hebert et al. ..... 62/79
4,747,273 A * 5/1988 Cook et al. ..... 62/238.6
5,211,023 A * 5/1993 Matsuura ..... 62/117
5,465,588 A * 11/1995 McCahill et al. ..... 62/127
5,613,372 A * 3/1997 Beal et al. ..... 62/434
6,250,086 B1 * 6/2001 Cho et al. ..... 62/5

FOREIGN PATENT DOCUMENTS

| | | |
|---|---|---|
| EP | 0 107 495 | 5/1984 |
| EP | 0 115 452 | 8/1984 |
| FR | 2548769 | 1/1985 |
| FR | 2 552 862 | 4/1985 |

* cited by examiner

*Primary Examiner*—William C. Doerrler
*Assistant Examiner*—Filip Zec
(74) *Attorney, Agent, or Firm*—Young & Thompson

(57) ABSTRACT

A heat pump system for raising the temperature of a fluid includes a compressor for compressing a working fluid; a desuperheater heat exchanger provided with an inlet and outlet for a fluid to be heated and an inlet and outlet for the working fluid, the working fluid inlet being communicated with an outlet from the compressor; a condenser heat exchanger provided with an inlet and outlet for the fluid to be heated and an inlet and outlet for the working fluid, the condenser heat exchanger fluid outlet being communicated directly with the desuperheater heat exchanger fluid inlet, and the condenser heat exchanger working fluid inlet being communicated directly with the desuperheater heat exchanger working fluid outlet; and an evaporator with an inlet communicated with the condenser heat exchanger working fluid outlet, and an outlet communicated with an inlet to the compressor.

13 Claims, 3 Drawing Sheets

HEAT PUMP FLUID HEATING SYSTEM

TECHNICAL FIELD

This invention relates to a heat pump fluid heating system for producing hot fluid at temperatures at least equal to the condensing temperature in a heat pump system. In particular, the present invention relates to a heat pump fluid heating system for producing hot water at high temperatures, suitable for use as a processing heat source such as in a milk pasteurizing system.

BACKGROUND ART

Heat pump fluid heating systems are used for example to heat water for various applications such as for domestic hot water, or swimming pools.

These systems generally utilize a heat pump cycle using a compressor, a condenser, and evaporator. In the case of domestic water heating where higher temperatures are required, the water may be heated to a high temperature using the superheat from the superheated working fluid exiting the compressor.

U.S. Pat. No. 5,901,563 to Yarbrough et. al. discloses a heat pump heat transfer system which includes a refrigerant to water heat exchanger, known in the art as a desuperheater, for transferring superheat from the compressed gas exiting the compressor to a domestic hot water service. This enables higher temperatures to be reached as required for domestic hot water systems. However, water is only heated at the desuperheater, and while a high temperature can be obtained, the flow rate is small.

For other applications such as for a processing heat source however, heat pumps have had little application, due to their inability to produce useful flowrates at the required higher temperatures, stemming from the fact that the flow of fluid to be heated (referred to hereunder as heated fluid) necessary for the working fluid condensation is considerably greater than is required to de-superheat the same working fluid, yet only the latter phase possesses the capacity to raise the heated fluid to higher temperatures. This imbalance results in either the provision of a full heated fluid flow at generally lower temperatures, or as with Yarbrough, a small flow at a higher temperature. In this case, the lower temperature balance is of little or no value, unless low temperature applications are available.

FIG. 1 shows a conventional heat exchanger configuration for hot gas cooling of a heat pump system. With this configuration, a heat exchanger 1 is configured with a working fluid inlet 2 and outlet 3, and a coolant (heated fluid) inlet 4 and outlet 5. This configuration provides a reasonable output flowrate, but only at medium temperatures, being unsuited to most requirements for high temperature heated water.

The problem of obtaining higher flow rates for a high temperature system is somewhat overcome by U.S. Pat. No. 4,474,018 to Teagan which discloses a heat pump system for production of domestic hot water, which involves using a compressor section which provides working fluid in a multiplicity of pressures. With this arrangement, water is heated in series connected heat exchangers, each provided with condensing coils in separate loops. Having the condensing coils in separate loops enables the plant to be designed for optimum performance, since flow rates and temperatures can be varied for the separate loops. With this design each of the heat exchanger/condensor sections combine desuperheating and condensing, and are in effect the same as shown in FIG. 1. While having separate loops enables design for optimum performance, this adds to the complexity of the system and hence cost and size.

Furthermore, neither of the above patents disclose the use of a liquid/gas heat exchanger to improve the system economy by transferring heat between the working fluid output from the condenser and the working fluid input to the compressor. Nor do they disclose the possibility of also using the heat pump to concurrently provide chilled water, such as is required for example in a milk pasteurizing plant.

DISCLOSURE OF INVENTION

It is an object of the present invention to address the above problems, and provide a heat pump fluid heating system which enables a compact design, and which can achieve sufficient flows of high temperature fluid for use in processing plants such as for sterilizing, and pasteurizing.

Moreover it is an object to provide a method of determining the required heated fluid mass flow rate and heated fluid entering temperature for such a heat pump fluid heating system.

According to one aspect of the present invention there is provided a heat pump system for raising the temperature of a heated fluid, comprising;

a compressor for compressing a working fluid, a desuperheater heat exchanger provided with an inlet and outlet for the heated fluid and an inlet and outlet for the working fluid, the working fluid inlet being communicated with an outlet from the compressor, a condenser heat exchanger provided with an inlet and outlet for the heated fluid and an inlet and outlet for the working fluid, the condenser heat exchanger heated fluid outlet being communicated directly with the desuperheater heat exchanger heated fluid inlet, and the condenser heat exchanger working fluid inlet being communicated directly with the desuperheater heat exchanger working fluid outlet, and an evaporator with an inlet communicated with the condenser heat exchanger working fluid outlet, and an outlet communicated with an inlet to the compressor.

The compressor may be any suitable device such as a rotary compressor, a screw compressor or a reciprocating compressor, in either single or multiple stages. Moreover, two or more compressors may be provided as required.

The evaporator may be any conventional evaporator used for a heat pump system, such as an air cooled or liquid cooled evaporator. In the case where process cooling is also required, the evaporator may be a liquid cooled heat exchanger adapted for connection to a liquid recirculation system, for providing cooling.

The desuperheater heat exchanger and the condenser heat exchanger may be arranged in any suitable configuration, provided these are connected in series. For example the desuperheater heat exchanger may be arranged above the condenser heat exchanger so that any condensate from the desuperheater heat exchanger will flow down into the condenser heat exchanger.

In a preferred embodiment, where economy of space is a prerequisite, the desuperheater heat exchanger may be arranged so that a working fluid outlet therefrom is below an inlet to the condenser heat exchanger, and there is provided a device for carrying any condensate into the condenser heat exchanger inlet.

With this arrangement, the desuperheater heat exchanger and the condenser heat exchanger may be arranged side by side, thus providing a compact arrangement.

The device for carrying condensate may comprise any suitable device. For example this may comprise piping between the heat exchangers sized and formed so that any condensate from the desuperheater heat exchanger is carried by flow of gaseous working fluid into the inlet of the condenser heat exchanger. A typical arrangement man involve a standard "P" trap.

According to another aspect of the present invention the heat pump system as described above is further provided with a liquid/gas heat exchanger arranged and configured so as to transfer heat from the working fluid output from the condenser heat exchanger to the working fluid input to the compressor.

The invention also covers a method of determining heated fluid mass flow rate and heated fluid entering temperature for a heat pump system comprising a desuperheater heat exchanger and a condensor heat exchanger connected in series with a heated fluid flowing in series through the desuperheater heat exchanger and condensor heat exchanger, comprising the steps of;

specifying a required heated fluid discharge temperature A, a required working fluid condensing temperature B, a required desuperheater heat exchanger duty C, a required condenser heat exchanger duty D, a temperature difference between the working fluid and heated fluid at exit of the condenser heat exchanger F, and the specific heat capacity of the heated fluid G;

determining a heated fluid mass flow rate H according to the following formula;

$$H = \frac{C}{G[A-(B-F)]}$$

and then determining a heated fluid entering temperature E according to the following formula;

$$E = (B-F) - \left(\frac{D}{G \times H}\right)$$

The invention also covers a heat pump system for raising the temperature of a fluid, comprising a desuperheater heat exchanger and a condenser heat exchanger connected in series, wherein required heat transfer duties of the desuperheater heat exchanger and the condenser heat exchanger are determined so that a fluid passed in series through these heat exchangers when operating at specified condensing and evaporating temperatures of a working fluid, becomes heated to a specified temperature of at least the condensing temperature of the working fluid.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
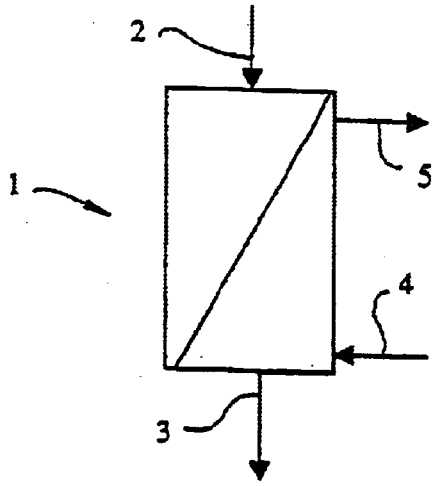
FIG. 1 is a schematic diagram of a conventional heat exchanger configuration for hot gas cooling of a heat pump system.
Figure 2:
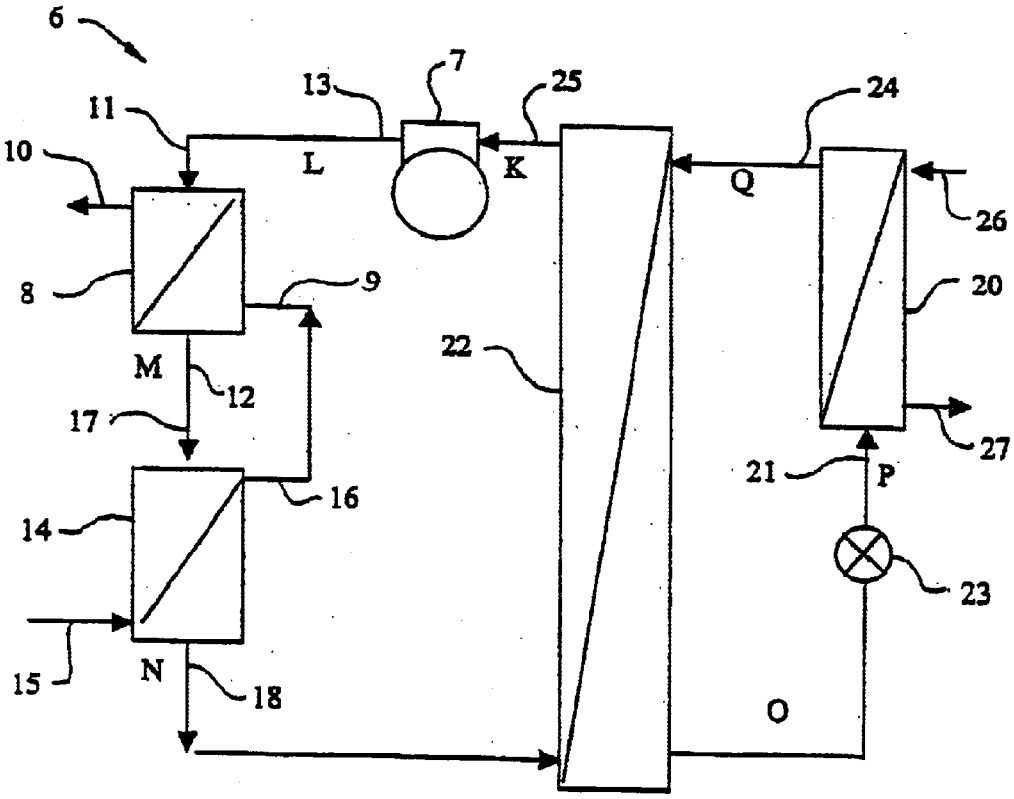
FIG. 2 is a schematic diagram of a heat pump system according to a first embodiment of the present invention.

With reference to FIG. 2, there is shown a heat pump system generally indicated by arrow 6 according to an embodiment of the invention. The letters in FIG. 2 refer to locations around the circuit, which are discussed later with reference to FIG. 3.

The heat pump system 6 is charged with a working fluid such as a halogenated or natural type working fluid. Such working fluids include for example: the HFC group (hydro-fluoro-carbons), the HC group (hydro-carbons), the FC group (fluoro-carbons), or blends composed of the preceding working fluids. Also, ammonia, water, carbon di-oxide and other inorganics may be used as the working fluid. With the present embodiment HFC refrigerant R134a is used.

The heat pump system 6 comprises a compressor 7 for compressing the working fluid, a desuperheating heat exchanger 8 provided with an inlet 9 and outlet 10 for a heated fluid and an inlet 11 and outlet 12 for the working fluid. The compressor 7 may be any suitable refrigerant compressor. Preferably this would be of a hermetic or semi hermetic type where working fluid also cools the prime mover. In order to obtain the high pressures for the working fluid cycle, it is generally envisioned that this would be a reciprocating type compressor of either single or multi-stage configuration, however other compressors may also be suitable. Moreover, the motor for driving the compressor may be operated at either a constant or a variable speed. Furthermore, two or more compressors may be provided as required. Where economically indicated, and usually in situations with larger heating capacity requirements, the working fluid pressure gradient between an evaporator 20 and the desuperheater heat exchanger 8 may be reduced by replacing the single stage compressor 7 with either multiple single-stage compressors set in a series arrangement so as to share the pressure gradient between them in such proportion as may be found desirable, or alternatively by selection of a multi-stage compressor or compressors to match the sought duty.

The working fluid inlet 11 of the desuperheating heat exchanger 8 is communicated with an outlet 13 from the compressor 7. The system also comprises a condenser heat exchanger 14 provided with an inlet 15 and outlet 16 for the heated fluid and an inlet 17 and outlet 18 for the working fluid. The condenser heat exchanger working fluid inlet 17 is communicated directly with the superheater heat exchanger working fluid outlet 12, and the condenser heat exchanger heated fluid outlet 16 is communicated directly with the superheater heat exchanger heated fluid inlet 9. Moreover, there is provided the evaporator 20 with an inlet 21 communicated with the condensing heat exchanger working fluid outlet 18 via the liquid side of a liquid/gas heat exchanger 22 and an expansion valve 23, and an outlet 24 communicated with an inlet 25 to the compressor 7 via the vapour side of the liquid/gas heat exchanger 22. The evaporator 20 is cooled by a coolant such as air or water, which is input at a coolant inlet 26 and discharged at a coolant outlet 27.

The provision of the liquid/gas heat exchanger 22 serves to increase the overall efficiency of the system by transferring heat from the working fluid output from the condenser heat exchanger 14 to the working fluid input to the compressor 25.

The arrangement of the heat pump system of FIG. 2 is aimed at satisfying the need to deliver water or other flows at both high temperatures and increased flowrates without wastage, and moreover to enable a compact design. In this respect, while the heat exchangers may be any conventional type of heat exchanger, it is found that brazed plate type heat exchangers generally have more complete performance specifications, and hence the circuit specification can be more accurately predicted if this type of heat exchanger is used.

With the heat pump system 6 of FIG. 2, heated fluid (fluid to be heated) is applied in series flow, first through the condenser heat exchanger 14 and then the desuperheater heat exchanger 8 in one undivided stream in counterflow to the working fluid. The heated fluid may be any suitable medium for absorbing heal In the case where the heat exchangers are connected to a recirculation system, it is generally envisioned that this would be water, or of an aqueous nature. Alternatively, in the case of connection to a non-return application, this would be the particular fluid to be heated.

In designing this system, it is essential that the heated fluid flow should fully serve the heat transfer requirements of both working fluid de-superheating and condensing, and that heated fluid temperatures be completely applicable to serve the sought duties of the main process, which may, but not necessarily, be for a pasteurizing process.

Requirements of temperature, rate of heat transfer and the types of working fluid and heated fluid to be used form the starting points to calculate the necessary heat transfer duties, and incorporate published data from compressor manufacturers relative to their particular product at the selected condensing, evaporating and suction gas temperatures in the formation of a balanced loop working fluid circuit as required of any normal heat pump system.

Figure 3:
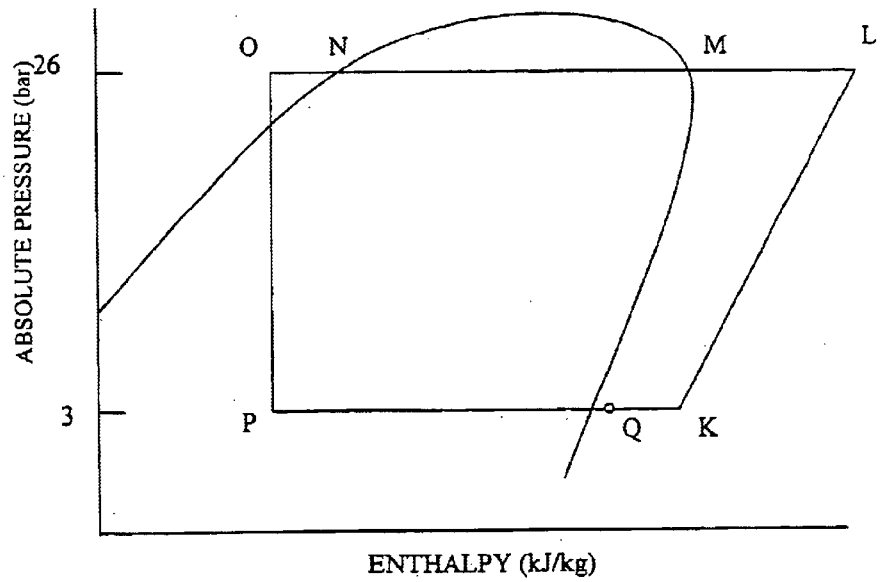
FIG. 3 is a working fluid pressure-enthalpy diagram for the working fluid cycle of the present invention.

FIG. 3 shows a working fluid pressure-enthalpy diagram for the working fluid cycle of the present invention. The Y-axis is the absolute pressure in bar and the X-axis is the enthalpy in kJ/kg. The letters K, L, M, N, O, P, Q are the conditions at the various locations in the circuit of FIG. 2. Here, K is the condition at the compressor inlet 25, L is the condition at the compressor outlet 13, M is the condition at the desuperheater heat exchanger outlet 12, N is the condition at the condenser heat exchanger outlet 18, O is the condition at the outlet from the liquid/gas heat exchanger 22, P is the condition at the evaporator inlet 21, and Q is the condition at the evaporator outlet 24. The curved line in FIG. 3 shows the interface between saturated liquid and saturated vapour, and between dry vapour and superheated vapour. In this diagram it can be seen that the heat given up from the condensate between N and O through the liquid/gas heat exchanger is transferred to the working fluid vapour between Q and K, thus improving the efficiency of the heating cycle.

Figure 4:
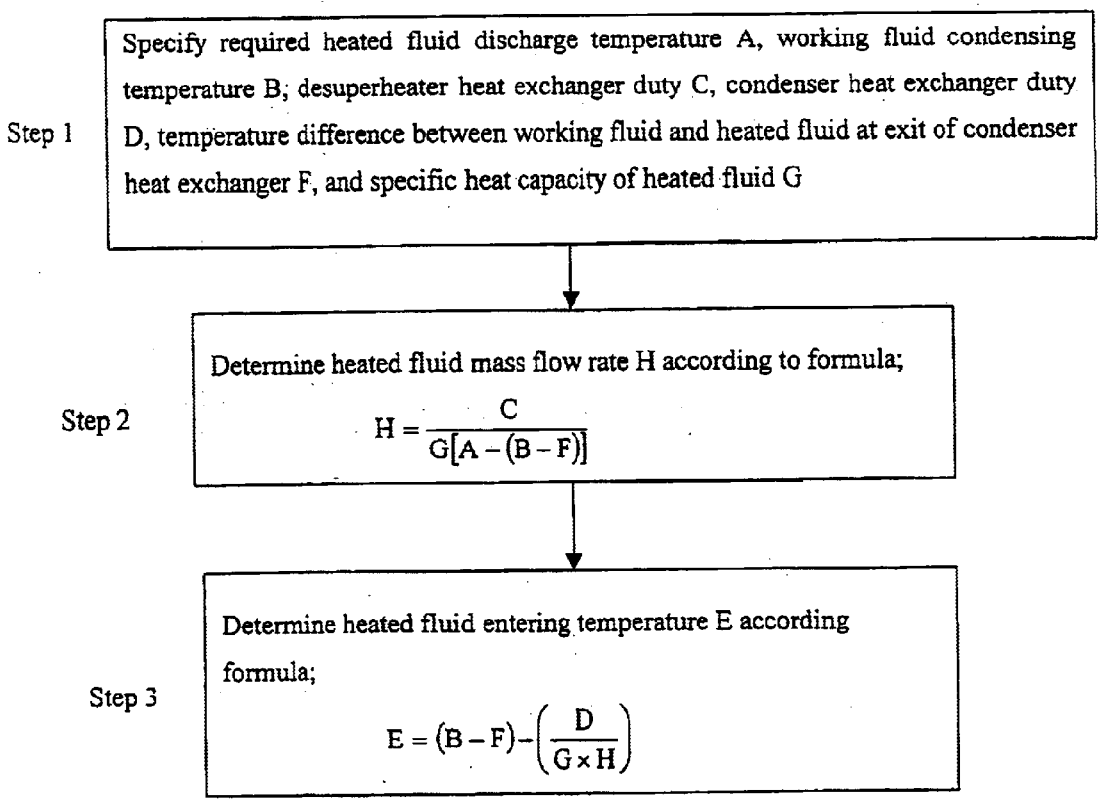
FIG. 4 is a flow chart illustrating a method of determining parameters according to the present invention.

The coolant flows and temperatures available for use in the particular principal process, are determined for example according to the flow chart of FIG. 4. In step 1 the required heated fluid discharge temperature A, the required working fluid condensing temperature B, the required desuperheater heat exchanger duty C, the required condenser heat exchanger duty D, the working fluid to heated fluid temperature difference at exit of the condenser heat exchanger F, and the specific heat capacity of the heated fluid G are specified.

Then in step 2 the heated fluid flow mass flow rate H is determined according to the following formula;

$$H = \frac{C}{G[A-(B-F)]}$$

Subsequently in step 3 the heated fluid entering temperature E is determined according to the following formula;

$$E = (B-F) - \left(\frac{D}{G \times H}\right)$$

Needless to say, appropriate changes to the many variables will allow of tailoring the resultant coolant temperatures to suit the principal process requirements of flow and temperature which may be beyond that available from conventional systems.

Figures for typical calculations according to the above method are given in Table 1. In these examples the heated fluid is water and the working fluid is refrigerant R134a.

TABLE 1

| Parameters | Example 1 | Example 2 |
|---|---|---|
| A - Required heated fluid discharge temperature | 85° C. | 92° C. |
| B - Required working fluid condensing temperature | 80° C. | 78° C. |
| C - Required desuperheater heat exchanger duty | 30 Kw | 30 Kw |
| D - Required condenser heat exchanger duty | 70 Kw | 70 Kw |
| E - Heated fluid entering temperature | ° C. | ° C. |
| F - Temperature difference between working fluid and heated fluid at exit of condenser heat exchanger | 5K | 3K |
| G - Specific heat capacity of heated fluid | 4.18 kJ/kcal | 4.18 kJ/kcal |
| H - Heated fluid mass flow rate | kg/s | kg/s |

In the case of Example 1

$$\text{Heated fluid mass flow rate } H = \frac{30}{4.18[85-(80-5)]} = 0.718 \text{ kg/s}$$

$$\text{Heated fluid entering temperature } E = (80-5) - \left(\frac{70}{4.18 \times 0.718}\right) = 51.7^\circ \text{ C. at condensor inlet 15 } (a' \text{ in FIG. 5})$$

In the case of example 2

$$\text{Heated fluid mass flow rate } H = \frac{30}{5 \times 4.18[92-(78-3)]} = 0.422 \text{ kg/s flow rate}$$

$$\text{Heated fluid entering temperature } E = (78-3) - \left(\frac{70}{4.18 \times 0.422}\right) = 35.3^\circ \text{ C. at condensor inlet 15 } (a'' \text{ in FIG. 5})$$

Figure 5:
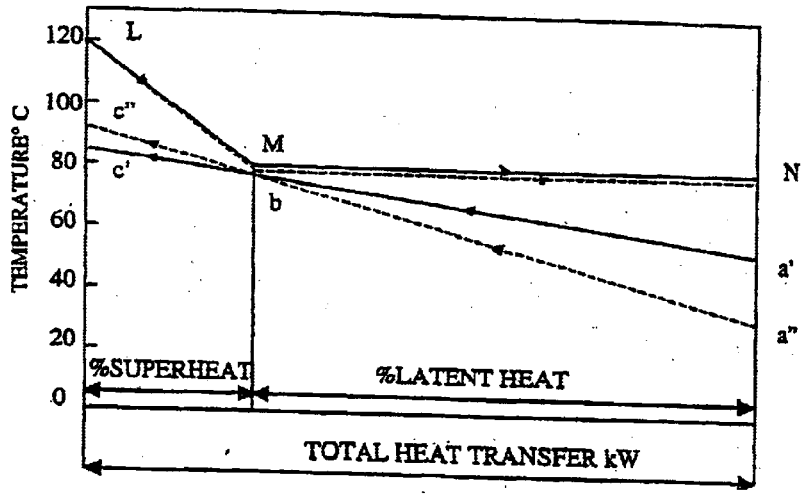
FIG. 5 is a heat transfer diagram for the present invention.

FIG. 5 is a heat transfer diagram for the present invention with the Y-axis showing temperature in degrees Celsius and the X-axis showing total heat transfer in kW. Letters L, M, N refer to conditions at the aforementioned locations L, M, N in FIG. 2 for the working fluid. Lines a', b, c' and a", b, c" show conditions for the heated fluid for the above examples 1 and 2 respectively. Points a' and a" correspond to the resultant heated fluid entering temperatures E, and points c' and c" correspond to the required heated fluid discharge temperatures A. In both example 1 and example 2 points c' and c" are above the respective required working fluid condensing temperatures B along the full and broken lines M–N.

The ratio of L to M and M to N along the X-axis indicates the proportion of superheat heat transfer to latent heat heat transfer in the total heat transfer process.

Figure 6:
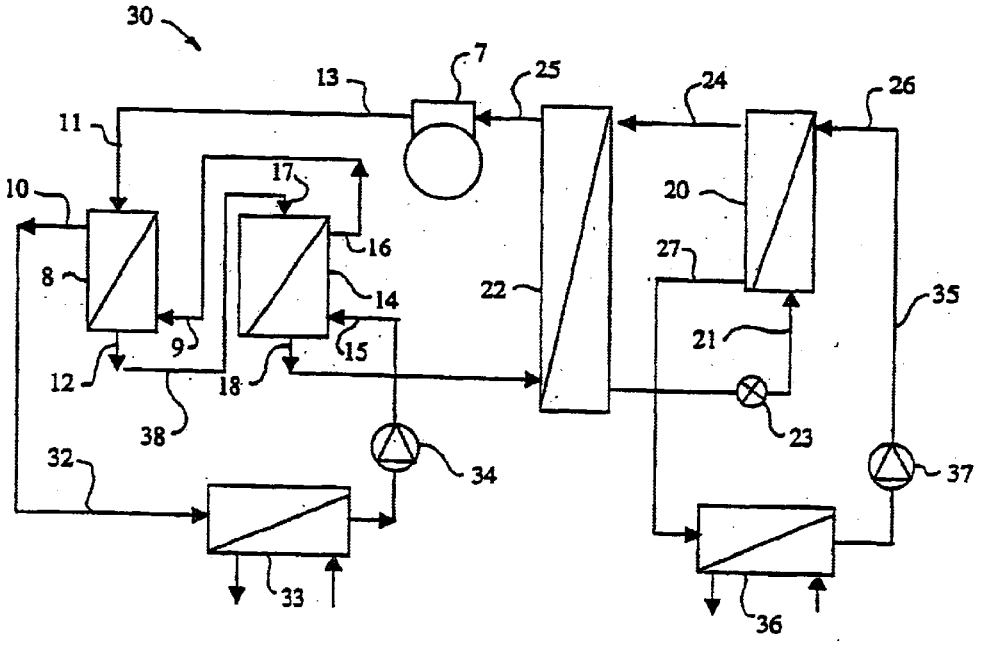
FIG. 6 is a schematic diagram of a heat pump system according to a second embodiment of the present invention.

FIG. 6 shows a second embodiment of a heat pump fluid heating system generally indicated by arrow 30 according to the present invention. In this figure, components having the same function as those in the first embodiment of FIG. 2 are denoted by the same symbols.

The heat pump fluid heating system 30 is designed for use in a processing plant such as a milk pasteurizing plant. As such, the heated fluid is circulated around a heating loop 32 incorporating a process heating load heat exchanger 33 by means of a circulation pump 34. Moreover, cooling fluid is circulated around a cooling loop 35 of a fluid recirculation system incorporating the evaporator 20 and a process cooling load heat exchanger 36 by means of a circulation pump 37. In the case of a pasteurizing plant the heating load would be the heat for heating milk to a pasteurizing temperature of around 72° C., and the cooling load would be that applied toward cooling the milk again.

With such an arrangement, the recirculation systems may be designed to satisfy either the whole or part of the heating and cooling requirements for a pasteurizing or a thermalising plant or the like.

Another feature of the second embodiment, is that the desuperheater heat exchanger 8 is arranged so that the working fluid outlet 12 therefrom is below the inlet 17 to the condenser heat exchanger 14. In this case, in order to carry condensate into the condenser heat exchanger inlet 17, piping 38 between the outlet 12 and the inlet 17 is sized and formed so that condensate from the desuperheater heat exchanger 8 is carried by flow of the gaseous working fluid into the inlet 17 of the condensor heat exchanger 14. A suitable device for achieving this may be a standard "P" trap fitted into the piping.

Test results from a pilot-sized plant have proven predictability of design, with constant and reliable 78° C. product hot water, and 4° C. cold water providing at least 37% of all required cooling.

The tested heat pump exhibited a 410% overall thermal efficiency, (4.10 COP) using electricity as the motive power.

Whereas pasteurizing had been the original goal of the invention, such other applications a thermalizing and general water heating are also foreseen.

It will be understood that all components utilized in the above described circuit are of conventional construction and are commercially available. The invention here relates not to the components, per se, but to the arrangement of such components in a circuit which can achieve sufficient flows of high temperature fluid for use in processing plants such as for sterilizing, and pasteurizing.

INDUSTRIAL APPLICABILITY

The present invention has industrial applicability in that it provides a heat pump fluid heating system which enables a compact design, and which can achieve sufficient flows of high temperature fluid for use in processing plants such as for sterilizing, and pasteurizing. Moreover, the invention can obviate the need for; a fired steam or hot water boiler, pressure vessel certification, safety surveys, water quality treatment and carbon emissions to the environment, and by the high COP figures will avail considerable economies in energy costs.

Aspects of the present invention have been described by way of example only and it should be appreciated that modifications and additions may be made thereto without departing from the scope of the invention as defined by the appended claims.

What is claimed is:

1. A heat pump system for raising the temperature of a single fluid to be heated, the single fluid to be heated referred to as a single heated fluid, comprising:

a compressor for compressing a working fluid;

a desuperheater heat exchanger provided with an inlet and outlet for said single heated fluid and an inlet and outlet for said working fluid, said working fluid inlet being communicated with an outlet from said compressor;

a condenser heat exchanger provided with an inlet and outlet for said single heated fluid and an inlet and outlet for said working fluid, said condenser heat exchanger heated fluid outlet being communicated directly with said desuperheater heat exchanger heated fluid inlet, and said condenser heat exchanger working fluid inlet being communicated directly with said desuperheater heat exchanger working fluid outlet; and an evaporator with an inlet communicated with said condenser heat exchanger working fluid outlet, and an outlet communicated with an inlet to said compressor.

2. A heat pump system according to claim 1, wherein said heat exchangers are adapted for connection to a non-return application.

3. A heat pump system according to claim 1, wherein said heat exchangers are adapted for connection to a fluid recirculation system.

4. A heat pump system according to claim 1, wherein said evaporator comprises a liquid cooled heat exchanger adapted for connection to a liquid recirculation system.

5. A heat pump system according to claim 4, wherein said recirculation systems satisfy either the whole or part of the heating and cooling requirements for a pasteurizing or thermalising plant.

6. A heat pump system according to claim 1, wherein said desuperheater heat exchanger is arranged so that a working fluid outlet therefrom is below an inlet to said condenser heat exchanger, and there is provided means for carrying any condensate into said condenser heat exchanger inlet.

7. A heat pump system according to claim 6, wherein said condensate carrying means comprises piping between said heat exchangers sized and formed so that any condensate from said desuperheater heat exchanger is carried by flow of gaseous working fluid into said inlet of said condenser heat exchanger.

8. A heat pump system according to claim 1, wherein said desuperheater heat exchanger, said condenser heat exchanger and said evaporator are brazed plate type heat exchangers.

9. A heat pump system according to claim 1, wherein said compressor is a reciprocating compressor.

10. A heat pump system according to claim 1, wherein there is further provided a liquid/gas heat exchanger arranged and configured so as to transfer heat from the working fluid output from said condenser heat exchanger to the working fluid input to said compressor.

11. A heat pump system according to claim 1, wherein said heated fluid is substantially water.

12. A method of determining heated fluid mass flow rate and heated fluid entering temperature for a heat pump system comprising a desuperheater heat exchanger and a condenser heat exchanger connected in series with a heated fluid flowing in series through said desuperheater heat exchanger and condenser heat exchanger, comprising the steps of;

specifying a required heated fluid discharge temperature A, a required working fluid condensing temperature B, a required desuperheater heat exchanger duty C, a required condenser heat exchanger duty D, a temperature difference between said working fluid and heated fluid at exit of said condenser heat exchanger F, and a specific heat capacity of said heated fluid G;

determining a heated fluid mass flow rate H according to the following formula;

$$H = \frac{C}{G[A - (B - F)]}$$

and then determining a heated fluid entering temperature E according to the following formula;

$$E = (B - F) - \left(\frac{D}{G \times H}\right)$$

13. A heat pump system for raising the temperature of a fluid, comprising a desuperheater heat exchanger and a condenser heat exchanger connected in series, wherein required heat transfer duties of said desuperheater heat exchanger and said condenser heat exchanger are determined so that a fluid passed in series through said heat exchangers when operating at specified condensing and evaporating temperatures of a working fluid, becomes heated to a specified temperature of at least the condensing temperature of said working fluid.

* * * * *